United States Patent [19]

Take

[11] 4,233,951

[45] Nov. 18, 1980

[54] IGNITION CIRCUIT FOR INTERNAL COMBUSTION ENGINES

[75] Inventor: Hisao Take, Shizuoka, Japan

[73] Assignee: Kabushiki Kaisha Kyoritsu Seisakujo, Shizuoka, Japan

[21] Appl. No.: 102,234

[22] Filed: Dec. 10, 1979

[30] Foreign Application Priority Data

Dec. 18, 1978 [JP] Japan ..... 53/157766

[51] Int. Cl.[3] ..... F02P 1/00

[52] U.S. Cl. ..... 123/625; 123/651; 123/149 C

[58] Field of Search ..... 123/148 E, 149 R, 148 CC; 310/70 R, 70 A

[56] References Cited

U.S. PATENT DOCUMENTS

| | | | |
|---|---|---|---|
| 3,938,491 | 2/1976 | Mazza | 123/148 E |
| 3,984,525 | 7/1976 | Haubner | 123/148 E |
| 4,144,859 | 3/1979 | Ohki | 123/148 E |
| 4,163,437 | 8/1979 | Notaras | 123/148 E |

*Primary Examiner*—Ronald B. Cox

*Attorney, Agent, or Firm*—Price, Heneveld, Huizenga & Cooper

[57] ABSTRACT

An improved ignition circuit for internal combustion engines is described herein, in which a diode is connected in parallel to a primary winding of an ignition coil of a magneto, and a composite transistor circuit consisting of two transistors whose forward direction is directed in the reverse direction of said diode, is connected across said primary winding at its collector and emitter, whereby overheating of said transistors caused by a primary reverse current of said magneto ignition coil flowing into the transistors can be prevented and also proper ignition timing can be maintained. In addition, in the improved ignition circuit a series circuit of a temperature compensating resistor and a resistor is connected between the base of said composite transistor circuit and one terminal of said primary winding, an anode-cathode path of a thyristor-equivalent circuit in which a collector of a PNP transistor is connected to a base of an NPN transistor and the base of said PNP transistor is connected to the collector of said NPN transistor, is connected between the junction of said temperature compensating resistor and said resistor and the other terminal of said primary winding, and the gate of said thyristor-equivalent circuit is connected to the base of said composite transistor circuit, whereby a primary forward current through said primary winding can be steeply cut off to provide a spark discharge at an especially high voltage.

6 Claims, 7 Drawing Figures

IGNITION CIRCUIT FOR INTERNAL COMBUSTION ENGINES

Figure 1:
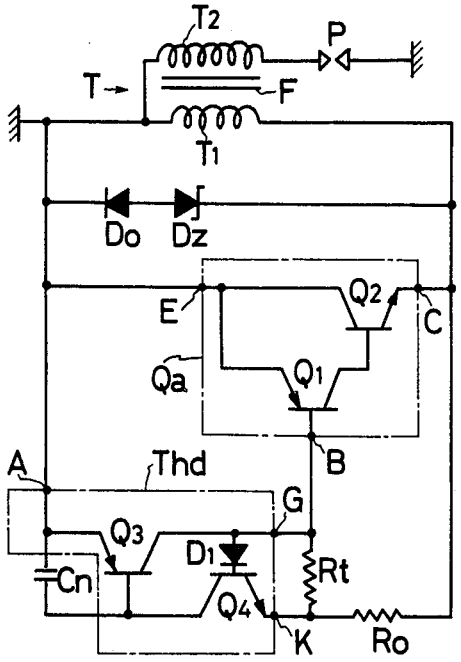

The present invention relates to improvements in a transistorized ignition circuit for internal combustion engines.

In the heretofore known transistorized ignition circuit for internal combustion engines, often a primary reverse current of a magneto flows into an amplifier circuit in the ignition circuit, resulting in overheating of transistors and thus deterioration of their performance, and this deterioration phenomenon is especially remarkable in the case of employing a dipole type of magneto in which said primary reverse current has the same magnitude and the same waveform as the primary forward current. Moreover, in the case where rotation of an internal combustion engine has become high speed, a control circuit for controlling conducting or non-conducting of the amplifier circuit would become conducting prior to conducting of the amplifier circuit for the primary current through the primary winding of the ignition coil due to phase shift between the currents through said amplifier circuit and through said control circuit, and consequently, a primary current to be cut off would disappear, so that the so-called high-speed miss fire phenomenon in which a high voltage is not generated across the secondary winding of said ignition coil might possibly occur. Furthermore, there were problems such that if the ambient temperature is widely varied, the timing of conducting of the control circuit would be disturbed and hence sufficient ignition energy could not be obtained in the secondary winding, and that in the case of transistorizing a magneto associated with a mechanical interrupter having fixed ignition timing, the cost would be raised.

It is a general object of the present invention to resolve the afore-mentioned problems in the prior art.

A first specific object of the present invention is to prevent overheating of transistors caused by a reverse current of a magneto and to maintain proper ignition timing.

A second specific object of the present invention is to abruptly cut off a primary forward current through an ignition coil for facilitating generation of a spark discharge at an especially high voltage.

A third specific object of the present invention is to regulate timing of ON-OFF of a transistorized ignition circuit and thereby prevent a miss fire phenomenon at a high speed.

A fourth specific object of the present invention is to make replacement of a magneto easy and less expensive when a magneto associated with a mechanical interrupter having fixed ignition timing is replaced by a transistorized magneto.

A fifth specific object of the present invention is to provide an ignition circuit in which a spark voltage that is sufficient for ignition can be obtained over a temperature range extending from a low temperature to a high temperature.

According to one feature of the present invention, there is provided an ignition circuit for internal combustion engines, in which a diode is connected in parallel to a primary winding of an ignition coil of a magneto, also a composite transistor circuit consisting of two transistors whose forward direction is directed in the reverse direction of said diode, is connected across said primary winding at its collector and emitter, a series circuit of a temperature compensating resistor and a resistor is connected between the base of said composite transistor circuit and one terminal of said primary winding, an anode-cathode path of a thyristor-equivalent circuit in which a collector of a PNP transistor is connected to a base of an NPN transistor and the base of said PNP transistor is connected to the collector of said NPN transistor, is connected between the junction of said temperature compensating resistor and said resistor and the other terminal of said primary winding, and the gate of said thyristor-equivalent circuit is connected to the base of said composite transistor circuit so that the gate current of said thyristor-equivalent circuit may be fed by the voltage drop across said temperature compensating resistor.

Figure 3:
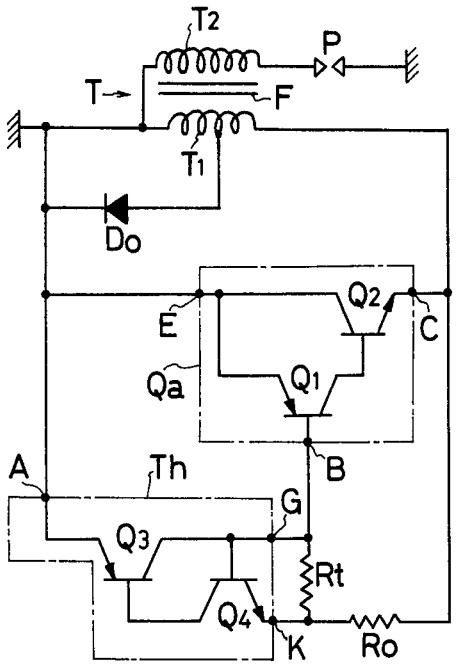
Figure 4:
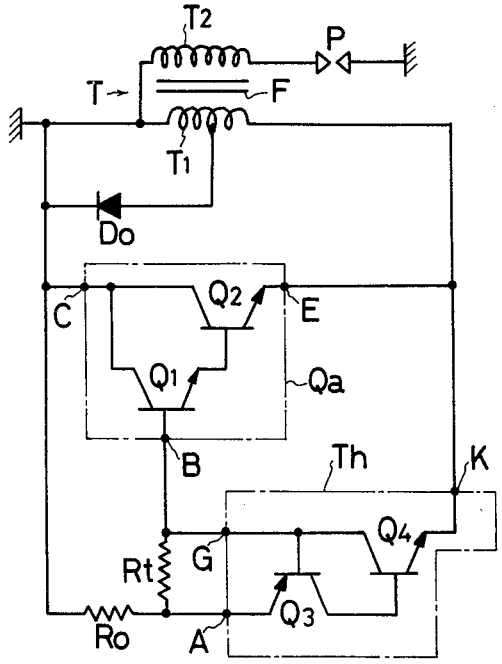
Figure 5:
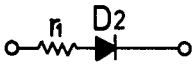
Figure 6:
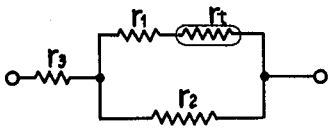
Figure 7:
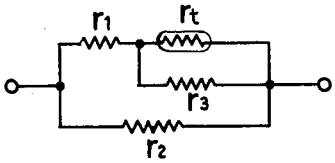

The above-mentioned and other features and objects of the present invention will become more apparent by reference to the following description of its preferred embodiments taken in conjunction with the accompanying drawings:

FIGS. 1 through 4 are electric circuit diagrams showing various preferred embodiments of the present invention, and FIGS. 5 to 7 are partial circuit diagrams showing different modes of embodiments of one part of the electric circuits illustrated in FIGS. 1 to 4.

In all the circuits shown in FIGS. 1 to 4, reference character T designates an ignition coil of a magneto, in which a primary winding $T_1$ and a secondary winding $T_2$ having a higher turn ratio than the former are wound around an iron core F. Reference character P designates an ignition plug, whose insulated electrode is connected to an end-of-turn terminal of the secondary winding $T_2$. A ground terminal of the ignition plug P and start-of-turn terminals of the primary winding $T_1$ and the secondary winding $T_2$ are grounded.

Figure 2:
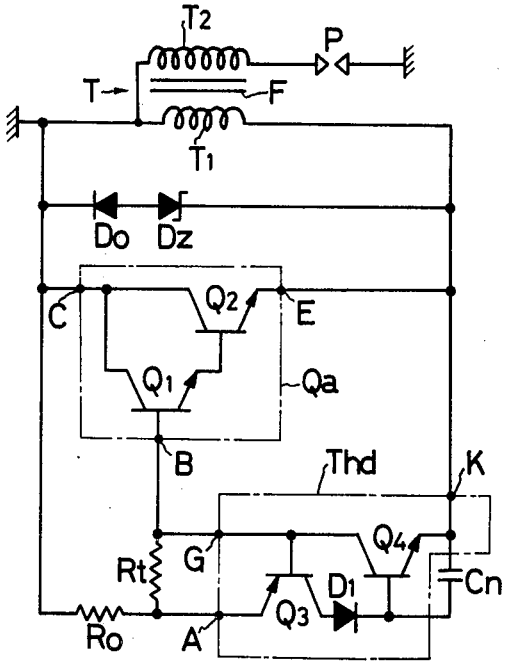

In the preferred embodiments shown in FIGS. 1 and 2, a series circuit of a diode $D_o$ and a constant voltage diode $D_z$ with their respective anodes connected to each other is connected across the primary winding $T_1$ in such polarity that a cathode of the diode $D_o$ is directed to the ground side. In the other preferred embodiments shown in FIGS. 3 and 4, the aforementioned constant voltage diode $D_z$ is omitted. A circuitry encircled by a chain line frame $Q_a$ is a composite transistor circuit consisting of transistors $Q_1$ and $Q_2$ that is well-known as a Darlington circuit, in which in the preferred embodiments shown in FIGS. 1 and 3 an emitter and a collector of a PNP transistor $Q_1$ are connected respectively to a collector and a base of an NPN transistor $Q_2$, while in the preferred embodiments shown in FIGS. 2 and 4 a collector and an emitter of an NPN transistor $Q_1$ are connected respectively to a collector and a base of an NPN transistor $Q_2$, and this composite transistor circuit $Q_a$ is connected across the primary winding $T_1$ at its composite collector C and composite emitter E.

In addition, a composite base B of the composite transistor circuit $Q_a$ is connected through a series circuit of a temperature compensating resistor $R_t$ and a resistor $R_o$ to the ungrounded terminal of the primary winding $T_1$ in the preferred embodiments shown in FIGS. 1 and 3, while it is connected through the same series circuit to the grounded terminal of the primary winding $T_1$, in the preferred embodiments shown in FIGS. 2 and 4.

In the preferred embodiments shown in FIGS. 1 and 2, a thyristor-equivalent circuit Thd is constructed by connecting a collector of a PNP transistor $Q_3$ via a diode $D_1$ to a base of an NPN transistor $Q_4$ and also connecting the base of the PNP transistor $Q_3$ directly to the collector of the NPN transistor $Q_4$. In the circuit shown in FIG. 1, an anode A and a cathode K of this thyristor-equivalent circuit Thd are connected respectively to the grounded terminal of the primary winding $T_1$ and the junction of the temperature compensating resistor $R_t$ and the resistor $R_o$, while in the circuit shown in FIG. 2 they are respectively connected to the junction of the temperature compensating resistor $R_t$ and the resistor $R_o$ and the ungrounded terminal of the primary winding $T_1$.

A gate G of the above-described thyristor-equivalent circuit Thd is the so-called P gate which is a junction point where the base of the transistor $Q_4$ is connected via the diode $D_1$ to the collector of the transistor $Q_3$ in the preferred embodiment shown in FIG. 1, whereas it is the so-called N-gate which is a junction point where the collector of the transistor $Q_4$ is connected directly to the base of the transistor $Q_3$ in the preferred embodiment shown in FIG. 2, and in either case the gate G of the thyristor-equivalent circuit Thd is connected to the composite base B of the composite transistor circuit $Q_a$.

In the preferred embodiments shown in FIGS. 3 and 4, a thyristor-equivalent circuit Th is constructed by connecting a collector of a PNP transistor $Q_3$ directly to a base of an NPN transistor $Q_4$ and also connecting the base of the PNP transistor $Q_3$ directly to the collector of the NPN transistor $Q_4$. In the circuit shown in FIG. 3, an anode A and a cathode K of this thyristor-equivalent circuit Th are connected respectively to the grounded terminal of the primary winding $T_1$ and the junction of the temperature compensating resistor $R_t$ and the resistor $R_o$, while in the circuit shown in FIG. 4 they are respectively connected to the junction of the temperature compensating resistor $R_t$ and the resistor $R_o$ and the ungrounded terminal of the primary winding $T_1$.

A gate G of the above-described thyristor-equivalent circuit Th is the so-called P gate which is a junction point where the base of the transistor $Q_4$ is directly connected to the collector of the transistor $Q_3$ in the preferred embodiment shown in FIG. 3, whereas it is the so-called N gate which is a junction point where the collector of the transistor $Q_4$ is connected directly to the base of the transistor $Q_3$ in the preferred embodiment shown in FIG. 4, and in either case the gate G of the thyristor-equivalent circuit Th is connected to the composite base B of the composite transistor circuit $Q_a$.

In the circuit shown in FIG. 1 a capacitor $C_n$ is connected in parallel to the base-emitter path of the transistor $Q_3$, whereas in the circuit shown in FIG. 2 a capacitor $C_n$ is connected in parallel to the base-emitter path of the transistor $Q_4$. FIGS. 3 and 4 shows examples of the ignition circuits in which the capacitor $C_n$ is omitted.

FIGS. 5, 6 and 7 illustrate different modes of embodiments of the circuit forming the aforementioned temperature compensating resistor $R_t$. In FIG. 5 the temperature compensating resistor $R_t$ is composed of a series connection of a resistor $r_1$ and a diode $D_2$, in FIG. 6 it is composed by connecting a resistor $r_3$ in series to a circuit formed by connecting a resistor $r_2$ in parallel to a series connection of a resistor $r_1$ and a thermistor $r_t$, and in FIG. 7 it is composed by connecting a resistor $r_2$ in parallel to a circuit formed by connecting a resistor $r_1$ in series to a parallel connection of a resistor $r_3$ and a thermistor $r_t$.

The ignition circuit for internal combustion engines according to the present invention is constructed as described above, and in response to rotation of an internal combustion engine, an A.C. voltage is generated across the opposite terminals of the primary winding $T_1$ in the ignition coil of a magneto shown in FIGS. 1 to 4. In FIGS. 1 and 2 a terminal voltage across the primary winding $T_1$ whose positive voltage appears at the ungrounded terminal, is applied across the series circuit of the diode $D_o$ and the constant voltage diode $D_z$, and if the combustion engine attains such rotational speed $n_o$ that the applied voltage reaches a value exceeding the sum of the forward voltage $V_{FO}$ of the diode $D_o$ and the Zener voltage $V_z$ of the constant voltage diode $D_z$, then the so-called primary reverse current begins to flow through the primary winding $T_1$.

In this case, at the rotational speed of the internal combustion engine higher than the aforementioned rotational speed $n_o$, the primary inverse current can be prevented from flowing into the composite transistor circuit $Q_a$ by presetting the Zener voltage $V_z$ of the constant voltage diode $D_z$ somewhat lower than the rated maximum voltage $V_{EB20}$ of the transistor $Q_2$. In addition, by preventing the primary reverse current from flowing through the primary winding $T_1$ until the rotational speed of the internal combustion engine attains the aforementioned rotational speed $n_o$, the delay of the time when the primary forward current reaches the cut-off value can be reduced, and thereby proper ignition timing can be maintained over the entire rotational speed range.

In the preferred embodiments shown in FIGS. 3 and 4, a primary voltage generated across a part of the primary winding $T_1$ is applied across the diode $D_o$, and hence a primary reverse current flows through a part of the primary winding $T_1$. Consequently, the primary reverse current flowing into the composite transistor circuit $Q_a$ can be limited, and the delay of the time when the primary forward current reaches the cut-off value can be reduced.

In the circuits shown in FIGS. 1 to 4, when the terminal voltage across the primary winding $T_1$ whose positive voltage appears at the grounded terminal begins to be generated, a base current of the composite transistor circuit $Q_a$ flows from the base B of the composite transistor circuit $Q_a$ through the series circuit consisting of the temperature compensating resistor $R_t$ and the resistor $R_o$ which circuit serves as a bias resistor, subsequently through the collector-emitter path of the composite transistor circuit $Q_a$ flows a primary forward current of the primary winding $T_1$ amplified by the transistors $Q_1$ and $Q_2$, and thus the composite transistor circuit $Q_a$ operates as an amplifier circuit for the primary forward current.

In FIG. 1, if the base current of the aforementioned composite transistor circuit $Q_a$ flowing through the temperature compensating resistor $R_t$ is increased, the voltage drop across the temperature compensating resistor $R_t$ exceeds the sum of the respective threshold values of the forward voltage $V_{F1}$ of the diode $D_1$ and the base-emitter voltage $V_{BE4}$ of the transistor $Q_4$ and thus the transistor $Q_4$ becomes conducting, so that the transistor $Q_3$ becomes conducting subsequently, and thereby short-circuits between the composite base B and the composite emitter E of the composite transistor circuit $Q_a$.

In FIG. 2, if the base current of the composite transistor circuit $Q_a$ flowing through the temperature compensating resistor $R_t$ is increased and the voltage drop across the temperature compensating resistor $R_t$ exceeds the threshold value of the base-emitter voltage $V_{BE3}$ of the transistor $Q_3$, then the transistor $Q_3$ becomes conducting, so that the transistor $Q_4$ becomes conducting subsequently, and thereby short-circuits between the composite base B and the composite emitter E of the composite transistor circuit $Q_a$.

In this way, the thyristor-equivalent circuit Thd serves as a control circuit for the primary forward current through the primary winding $T_1$ so that the primary forward current of the primary winding $T_1$ flowing through the composite transistor circuit $Q_a$ can be steeply cut off. Owing to the electromagnetic induction effect caused by this steep cut-off, a high voltage can be induced across the secondary winding $T_2$ having a high turn ratio of the ignition coil T, and thereby a spark discharge is generated at the ignition plug P.

In the above-described operation that the thyristor-equivalent circuit Thd serving as a control circuit is made to conduct by the base current of the composite transistor circuit $Q_a$ serving as an amplifier circuit for the primary forward current through the primary winding $T_1$ and thereby the composite transistor circuit $Q_a$ is cut off, the primary forward current can be cut off within an extremely minute period of time owing to the positive feedback effect of the thyristor-equivalent circuit Thd, and thereby an especially very high voltage is generated across the secondary winding $T_2$. For the purpose of maintaining this effect over the entire rotational speed range of the internal combustion engine, a capacitor $C_n$ having a small capacitance is connected in parallel to the base-emitter path of the transistor $Q_3$ or $Q_4$ in the thyristor-equivalent circuit Thd so that the thyristor-equivalent circuit Thd serving as a control circuit may not become conducting prior to the conducting of the composite transistor circuit $Q_a$ serving as an amplifier circuit for the primary forward current when the rotational speed of the internal combustion engine becomes high. The action of the capacitor $C_n$ is to delay the start of conducting of the thyristor-equivalent circuit Thd by the minute period necessitated for its charging and thereby adjust the timing. However, the capacitor $C_n$ does not hinder the positive feedback effect in the start-to-conduct condition.

In the thyristor-equivalent circuit Thd, the forward voltage $V_{F1}$ of the diode $D_1$ increases in accordance with the rise of the rotational speed of the magneto in the internal combustion engine, so that the ignition angle of the magneto is shifted to lag-direction almost over the entire region of the rotational speed. As a result, the magneto associated with the ignition circuit according to the present invention can be matched with the prior art magneto such as that associated with a mechanical interrupter having fixed ignition timing whose ignition angle generally has a lag of a few degrees with respect to an ignition angle of a transistorized magneto. Accordingly, between these different ignition devices the ignition timing of the internal combustion engine can be made substantially equal without changing the relative positioning of the rotor consisting of a magnet system and the ignition coil of the magneto with respect to the internal combustion system at all.

The circuit of the temperature compensating resistor $R_t$ shown in FIG. 5 makes use of the fact that the forward voltage $V_{F2}$ of the diode $D_2$ is reduced as the ambient temperature rises, and this circuit is useful in the case where the variation of the ambient temperature occurs in a small range.

The circuits of the temperature compensating resistor $R_t$ shown in FIGS. 6 and 7, respectively, make use of the fact that the resistance value of the thermister $r_t$ is exponential functionally reduced as the ambient temperature rises. In the case where the variation of the ambient temperature occurs in a medium range the circuit shown in FIG. 6 is useful, whereas in the case where the variation of the ambient temperature occurs in a wide range the circuit shown in FIG. 7 is useful.

Thus according to the present invention, a temperature compensating circuit which can operate almost perfectly over the entire range of the ambient temperature change, can be constructed, and especially at a low starting rotational speed of an internal combustion engine the secondary high voltage generated across the secondary winding $T_2$ of the ignition coil T can feed a spark voltage sufficient for ignition to the spark plug P at any arbitrary ambient temperature.

In addition, according to the present invention, since a temperature compensating resistor $R_t$ whose resistance reduces in accordance with rise of an ambient temperature is used in a bias circuit for a base current in the composite transistor circuit $Q_a$, the base current increases as the ambient temperature rises, and accordingly upon cutting off the primary forward current flowing through the composite transistor circuit $Q_a$, the current value can be increased, so that lowering of a secondary voltage upon a high temperature as will be often seen in the transistor ignition circuits in the prior art would not occur.

Firstly, the ignition circuit according to the present invention can prevent a large inverse current generated by a dipole type magneto which current has the same waveform and the same magnitude as the forward current from flowing through the composite transistor circuit $Q_a$ with a simple and small-size device either by connecting a series circuit of a diode $D_o$ and a constant voltage diode $D_z$ across the primary winding as shown in FIGS. 1 and 2 or by connecting a diode $D_o$ across the primary winding as shown in FIGS. 3 and 4, consequently overheating of the transistor $Q_2$ is prevented. It is a matter of course that these ignition circuits shown in FIGS. 1 to 4 are all available in association with a three pole type magneto or other types of magnetos. Also in these ignition circuits, since the reverse current which delays establishment of the forward current through the primary winding is limited, there exists an advantage that proper ignition timing of an internal combustion engine can be maintained.

Secondly, since the cut-off of the primary forward current can be achieved extremely steeply within a minute period of time owing to the positive feedback effect of the thyristor-equivalent circuit Thd, an extremely high spark voltage can be easily generated.

Thirdly, if a small-size small-capacity capacitor $C_n$ is used in a thyristor-equivalent circuit Thd as shown in FIGS. 1 and 2, the timings of the composite transistor circuit $Q_a$ and the thyristor-equivalent circuit Thd can be matched with each other and the high-speed miss fire phenomenon can be more perfectly prevented without hindering the positive feedback effect of the latter circuit.

Fourthly, if the thyristor-equivalent circuit Thd is constructed as shown in FIGS. 1 and 2, the ignition timing of the internal combustion engine can be made almost equal to the ignition timing of a magneto associated with an interrupter having fixed ignition timing owing to the action of the diode $D_1$, so that replacement between these magnetoes can be achieved easily and without rise of the cost.

Fifthly, since the base current of the composite transistor circuit $Q_a$ is passed through the temperature compensating resistor $R_t$, a stable spark voltage can be obtained independently of a temperature change. By employing a specific one of the circuits shown in FIGS. 5 to 7 for the temperature compensating resistor $R_t$, a spark voltage that is sufficient for ignition over a desired temperature range can be assured.

While the present invention has been described above in connection to the preferred embodiments illustrated in the accompanying drawings, the present invention should not be limited only to these illustrated embodiments, but any partial modification of the illustrated embodiments should come within the scope of the invention so long as it does not depart from the spirit of the present invention.

What is claimed is:

1. An ignition circuit for internal combustion engines characterized in that a diode is connected in parallel to a primary winding of an ignition coil of a magneto, also a composite transistor circuit consisting of two transistors whose forward direction is directed in the reverse direction of said diode, is connected across said primary winding at its collector and emitter, a series circuit of a temperature compensating resistor and a resistor is connected between the base of said composite transistor circuit and one terminal of said primary winding, an anode-cathode path of a thyristor-equivalent circuit in which a collector of a PNP transistor is connected to a base of an NPN transistor and the base of said PNP transistor is connected to the collector of said NPN transistor, is connected between the junction of said temperature compensating resistor and said resistor and the other terminal of said primary winding, and the gate of said thyristor-equivalent circuit is connected to the base of said composite transistor circuit so that the gate current of said thyristor-equivalent circuit may be fed by the voltage drop across said temperature compensating resistor.

2. An ignition circuit for internal combustion engines as claimed in claim 1, in which said temperature compensating resistor is composed of a series connection of a resistor and a diode.

3. An ignition circuit for internal combustion engines as claimed in claim 1, in which said temperature compensating resistor is composed by connecting a resistor in series to a circuit formed by connecting another resistor in parallel to a series connection of yet another resistor and a thermistor.

4. An ignition circuit for internal combustion engines as claimed in claim 1, in which said temperature compensating resistor is composed by connecting a resistor in parallel to a circuit formed by connecting another resistor in series to a parallel connection of yet another resistor and a thermistor.

5. An ignition circuit for internal combustion engines characterized in that a series circuit of a diode and a constant voltage diode is connected across a primary winding of an ignition coil of a magneto, also a composite transistor circuit consisting of two transistors whose forward direction is directed in the reverse direction of said diode, is connected across said primary winding at its collector and emitter, a series circuit of a temperature compensating resistor and a resistor is connected between the base of said composite transistor circuit and one terminal of said primary winding, an anode-cathode path of a thyristor-equivalent circuit in which a collector of a PNP transistor is connected via a diode to a base of an NPN transistor and the base of said PNP transistor is connected to the collector of said NPN transistor, is connected between the junction of said temperature compensating resistor and said resistor and the other terminal of said primary winding, the gate of said thyristor-equivalent circuit is connected to the base of said composite transistor circuit so that the gate current of said thyristor equivalent circuit may be fed by the voltage drop across said temperature compensating resistor, and a capacitor is connected between a base and an emitter of one of the transistors in said thyristor-equivalent circuit.

6. An ignition circuit for internal combustion engines characterized in that a diode is connected in parallel to a part of a primary winding of an ignition coil of a magneto, also a composite transistor circuit consisting of two transistors whose forward direction is directed in the reverse direction of said diode, is connected across said primary winding at its collector and emitter, a series circuit of a temperature compensating resistor and a resistor is connected between the base of said composite transistor circuit and one terminal of said primary winding, an anode-cathode path of a thyristor-equivalent circuit in which a collector of a PNP transistor is connected directly to a base of an NPN transistor and the base of said PNP transistor is connected to the collector of said NPN transistor, is connected between the junction of said temperature compensating resistor and said resistor and the other terminal of said primary winding, and the gate of said thyristor-equivalent circuit is connected to the base of said composite transistor circuit so that the gate current of said thyristor-equivalent circuit may be fed by the voltage drop across said temperature compensating resistor.

* * * * *